US006913477B2

(12) United States Patent
Dayan et al.

(10) Patent No.: US 6,913,477 B2
(45) Date of Patent: Jul. 5, 2005

(54) WIREFREE MOBILE DEVICE POWER SUPPLY METHOD & SYSTEM WITH FREE POSITIONING

(75) Inventors: Tal Dayan, Los Gatos, CA (US); Ofer Goren, Palo Alto, CA (US); Elliott J. Stein, Morristown, NJ (US); Dan Kikinis, Saratoga, CA (US)

(73) Assignee: Mobilewise, Inc., Los Altos, CA (US)

( * ) Notice: Subject to any disclaimer, the term of this patent is extended or adjusted under 35 U.S.C. 154(b) by 69 days.

(21) Appl. No.: 10/211,191

(22) Filed: Aug. 1, 2002

(65) Prior Publication Data

US 2004/0048511 A1 Mar. 11, 2004

Related U.S. Application Data

(60) Provisional application No. 60/361,631, filed on Mar. 1, 2002, provisional application No. 60/361,626, filed on Mar. 1, 2002, and provisional application No. 60/361,602, filed on Mar. 1, 2002.

(51) Int. Cl.[7] ..... H01R 29/00

(52) U.S. Cl. ..... 439/188; 439/913

(58) Field of Search ..... 439/188, 246, 439/504, 488, 315, 911, 919, 913, 950

(56) References Cited

U.S. PATENT DOCUMENTS

| | | | | |
|---|---|---|---|---|
| 4,654,573 | A | | 3/1987 | Rough et al. |
| 5,535,274 | A | | 7/1996 | Braitberg et al. |
| 5,600,225 | A | | 2/1997 | Goto |
| 5,732,074 | A | | 3/1998 | Spaur et al. |
| 5,821,731 | A | | 10/1998 | Kuki et al. |
| 5,923,544 | A | | 7/1999 | Urano |
| 5,929,598 | A | | 7/1999 | Nakama et al. |
| 5,952,814 | A | | 9/1999 | Van Lerberghe |
| 5,959,433 | A | | 9/1999 | Rohde |
| 5,963,012 | A | | 10/1999 | Garcia et al. |
| 6,008,622 | A | | 12/1999 | Nakawatase |
| 6,016,046 | A | | 1/2000 | Kaite et al. |
| 6,028,413 | A | | 2/2000 | Brockmann |
| 6,040,680 | A | | 3/2000 | Toya et al. |
| 6,057,668 | A | | 5/2000 | Chao |
| 6,118,249 | A | | 9/2000 | Brockmann et al. |
| 6,122,514 | A | | 9/2000 | Spaur et al. |
| 6,275,143 | B1 | | 8/2001 | Stobbe |
| 6,316,909 | B1 | | 11/2001 | Honda et al. |
| 6,326,884 | B1 | * | 12/2001 | Wohlrabe ..... 340/310.01 |
| 6,341,218 | B1 | | 1/2002 | Poplawsky et al. |
| 6,377,825 | B1 | | 4/2002 | Kennedy et al. |
| 6,430,164 | B1 | | 8/2002 | Jones et al. |
| 6,594,471 | B1 | * | 7/2003 | Crowley et al. ..... 455/575.7 |
| 2002/0061739 | A1 | * | 5/2002 | Nakamura et al. ..... 455/343 |
| 2002/0089305 | A1 | | 7/2002 | Park et al. |
| 2002/0093309 | A1 | | 7/2002 | Peele |
| 2003/0009308 | A1 | * | 1/2003 | Kirtley ..... 702/141 |

FOREIGN PATENT DOCUMENTS

| | | | |
|---|---|---|---|
| DE | 40 11 198 | A | 10/1991 |
| EP | 0 116 505 | A | 8/1984 |
| FR | 2 271 952 | A | 12/1975 |
| FR | 2 613 883 | A | 10/1988 |
| WO | WO 93 15929 | A | 8/1993 |
| WO | WO 94 17328 | A | 8/1994 |

* cited by examiner

*Primary Examiner*—Gary Paumen
*Assistant Examiner*—James R. Harvey
(74) *Attorney, Agent, or Firm*—Blakely, Sokoloff, Taylor & Zafman LLP

(57) ABSTRACT

The invention provides an electrical coupling device. The coupling includes a contactor device and a plurality of electrical contacts which close an electrical circuit between the contactor device and an adaptor device when the adaptor device is brought into physical contact with the contactor device, there being no need for aligning for the electrical contacts of the contactor device with electrical contact of the adaptor device.

5 Claims, 11 Drawing Sheets

WIREFREE MOBILE DEVICE POWER SUPPLY METHOD & SYSTEM WITH FREE POSITIONING

CLAIM OF PRIORITY

This application hereby claims the benefit of application Ser. No. 60/361,631 filed on Mar. 1, 2002, titled Conductive Coupler With Three Degrees of Freedom, application Ser. No. 60/361,626, filed on Mar. 1, 2002, titled Automatic and Adaptive Power Supply and provisional Application No. 60/361,602 which was filed Mar. 1, 2002 titled Wireless Adaptive Power Provisioning System for Small Devices, each of which are hereby incorporated by reference.

FIELD OF THE INVENTION

This invention relates to mobile devices. In particular it relates to the connection or coupling arrangements for mobile devices whereby power or network connectivity is provided to the mobile devices.

BACKGROUND

Mobile devices such as notebook computers, personal digital assistants, mobile telephones, pagers etc. require periodic recharging, which generally involves connecting the mobile device to a charging unit which draws power from a wall socket.

Generally, electrical interconnection between the mobile device and the charging unit is achieved by a pin arrangement, which requires accurate alignment of electrical contact pins before charging can take place. Thus, the mobile device has to be held in a fixed spatial relationship to the charging device while charging takes place. This restricts the mobility, and hence the utility of the mobile device while charging takes place.

DETAILED DESCRIPTION

In the following description, for purposes of explanation, numerous specific details are set forth in order to provide a thorough understanding of the invention. It will be apparent, however, to one skilled in the art that the invention can be practiced without these specific details. In other instances, structures and devices are shown in block diagram form in order to avoid obscuring the invention.

Reference in this specification to "one case" or "a case" means that a particular feature, structure, or characteristic described in connection with the case is included in at least one case of the invention. The appearances of the phrase "in one case" in various places in the specification are not necessarily all referring to the same case, nor are separate or alternative cases mutually exclusive of other cases. Moreover, various features are described which may be exhibited by some cases and not by others. Similarly, various requirements are described which may be requirements for some cases but not other cases.

In one case, the invention provides an electrical coupling system ("CS") that allows the closing of an electrical circuit between two bodies, each with a surface that contains a conductive area. The CS provides three degrees of freedom between the two surfaces. The first degree comprises a linear movement along an X axis of an XY plane that is essentially co-planar to the larger of the bodies. The third degree comprises a rotation around a Z axis that is perpendicular to the XY plane. In some cases, free positioning contacts may include telescopic action in the Z axis direction (not shown).

Figure 1:
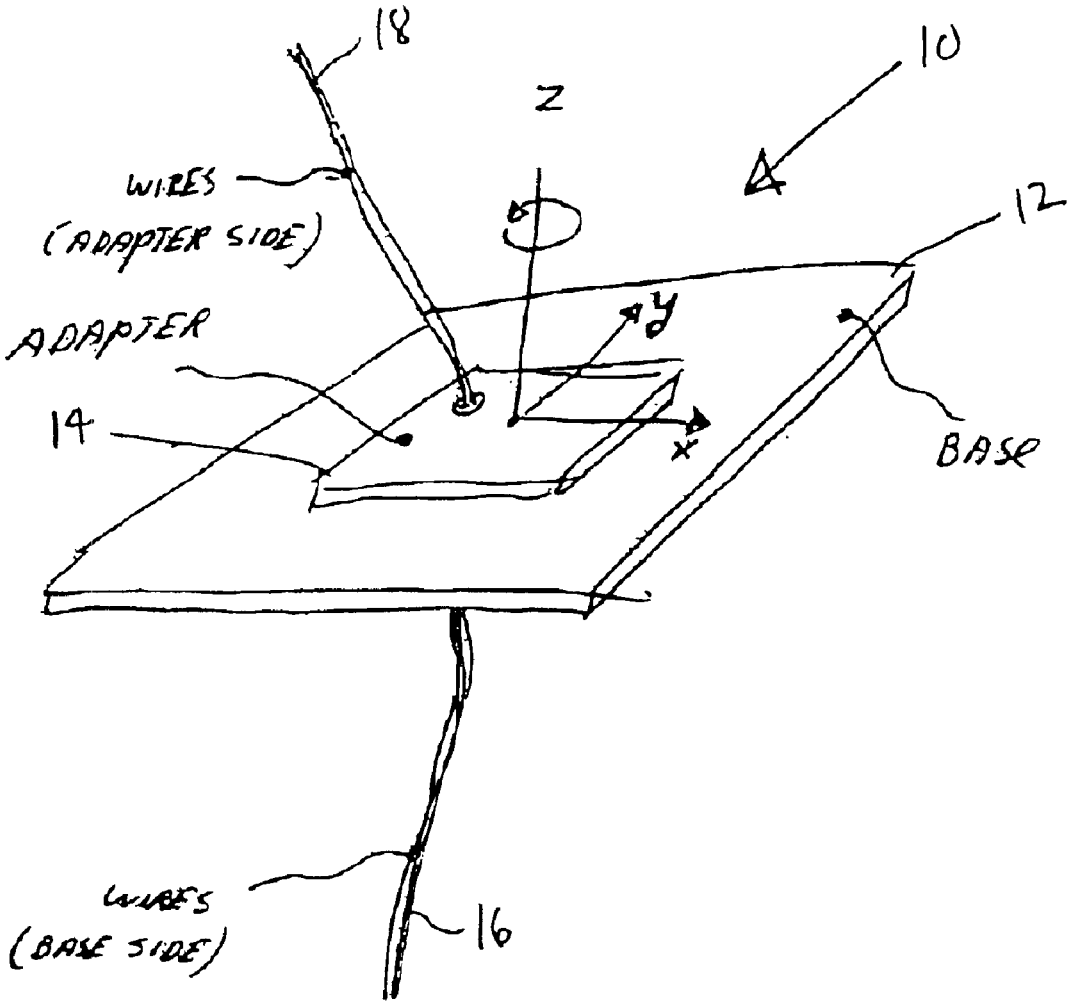
FIG. 1 shows a perspective view of a coupling system in accordance with the invention.

FIG. 1 shows a simplified perspective view of a coupling system 10 comprising conductive area 12 which forms part of a charging or base unit (not shown) which is typically stationary. The CS 10 also includes a second conductive area 14 which is part of an adapter unit (not shown). Also shown for orientation, is the above mentioned coordinate system comprising the x y plane and the Z axis perpendicular thereto. Electrical lead wires 16 and 18 electrically connect the conductive areas 12, 14, respectively to the base unit and the adaptor unit, respectively. The conductive areas 12, 14 may either be attached to the base unit and the adaptor unit, respectively, or, in a preferred case, integrated with the base unit and the adaptor unit, respectively. This allows a power circuit between the base unit and the adaptor unit to be closed, without requiring alignment, as is required by conventional connectors, power charging cradles, etc.

In one instance, the CS 10 may be used to provide power to notebook computers or other mobile devices by allowing the mobile devices to be placed freely on an energizing desktop or other surface which forms part of the base unit. In this instance, the desktop or other surface forms the conductive area 12 of the CS 10 and a bottom of the mobile device acts as the conductive area 14. A power supply is connected to the conductive area 12 of the desk or surface (such as a desk pad, writing pad, etc.) and can close an electrical circuit with the conductive area 14 of the mobile device placed thereupon, thus allowing e.g. a charging or power circuit of the mobile device to be energized independently of an XY, or angular position of the mobile device on the desk top or other surface.

When the conductive areas 12, 14 are brought into contact (typically the conductive area 14 is placed on top of the conductive area 12) the relative position can be expressed as a tuple of three numbers [X, Y, G] called "relative placement" or "placement" in short. The X and Y values denote the linear displacement between the centers of the conductive areas 12, 14 relative to the XY coordinate system. The G value denotes the relative radial angle in degrees between the conductive areas 12, 14, as projected onto the XY plane with some arbitrary relative rotation considered to have a rotation of zero degrees.

A placement is said to be "supported" or "active" if a closed electrical circuit can be formed between the base unit and the adaptor unit through electrical contacts on or adjacent conductive areas 12, 14, respectively. In one case, a set of active placements forms a continuous range without gaps. In other words, when the conductive area 14 rests on the conductive area 12, a placement is guaranteed to be active regardless of the relative position of the conductive area 14 and the conductive area 12.

Figure 2:
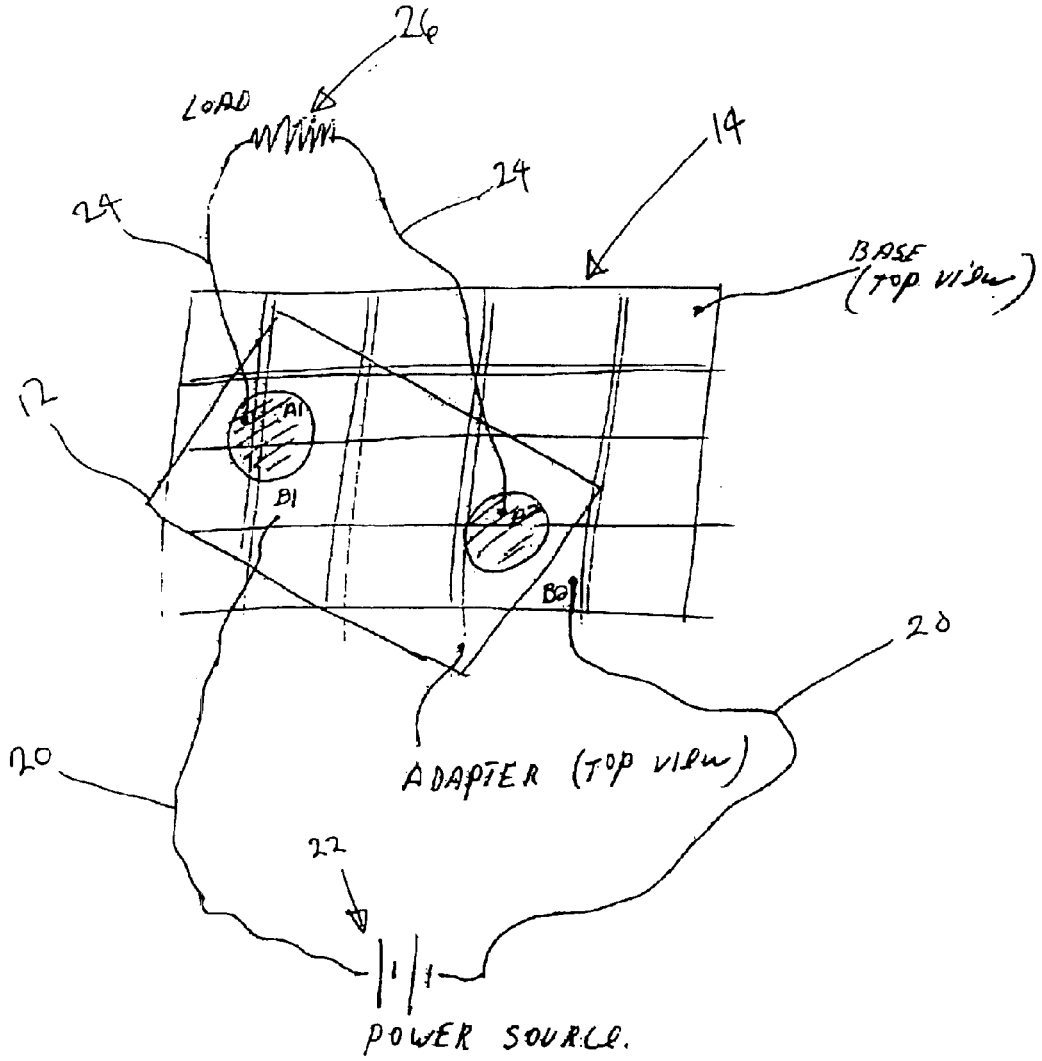
FIG. 2 shows a schematic drawing of an electrical connection between an adaptor unit and a base unit, in accordance with the invention.

FIG. 2 of the drawings shows a simplified view of an electrical connection between an adaptor unit and a base unit. As will be seen, the base unit comprises conductive area 14 which includes at least two electrical contacts B1 and B2 that are electrically connected via electrical lead wires 20 to a power source 22. The adaptor unit includes at least two electrical contacts A1 and A2 that are electrically connected via electrical lead wires 24 to a circuit of the mobile device, for example a power or charging circuit, which is depicted, in simplified form, as electrical load 26. A number, size, shape, dimension, spacing, and other spatial configuration aspects of the electrical contacts of the conductive surfaces 12 and 14 are such that for each placement that is in the active range, there is at least one pair of contacts B1 and B2 of the base unit, and at least one pair of contacts A1 and A2 of the adaptor unit that satisfy the following conditions:

(a) contactor B1 of the base unit touches A1 of the adaptor unit;

(b) contactor B2 of the base unit touches contactor A2 of the adaptor unit; and (c) the electrical contact of the base unit and the adaptor unit do not form a short circuit between electrical contacts B1 and B2.

When the above conditions are met a two wire electrical circuit can be formed between the base unit and the adaptor units using contacts A1–B1 as one lead and contact A1–B2 as the other lead. In some cases, where multi-phase power is required for each placement more than two contacts (for example three contacts) of the base unit may make contact with corresponding contacts of the adaptor unit to enable multi-phase power transmission between the base unit and the adaptor unit.

The routing of current to the pairs of contacts for each active placement can be done in many ways. In some cases, a sensing circuit detects a signal that is asserted by the adaptor unit contacts when they come into contact with the base unit contacts. The sensing circuit uses this information to activate the base unit contacts that are touched by the adaptor unit contacts. In other cases, the current can be redirected to the contacts by sensing the relative position of the conductive surfaces 12 and 14. In other cases, the base unit can switch power to a sequence of pairs of base unit contacts until it senses that the circuit is closed with the mobile device. In other cases, the current routing can be done by mechanical switches that are activated by the conductive areas 12, 14 based on their relative positions.

Figure 3:
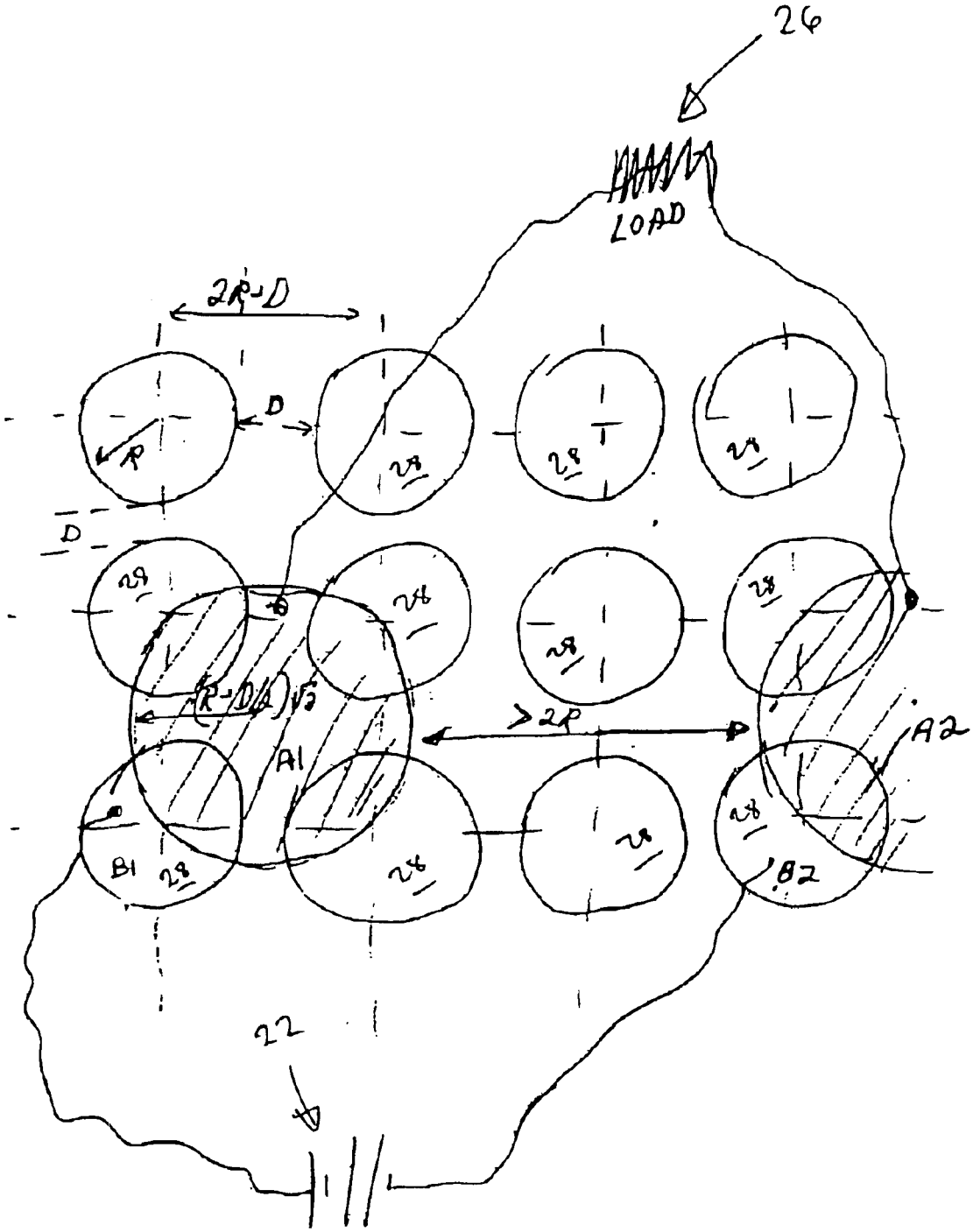
FIG. 3 shows an example of a coupling system implementation for a notebook computer.

FIG. 3 of the drawings shows an example of a CS implementation for a notebook computer. As described above, the adaptor unit includes an electrical load 26 that is electrically connected to two electrical contacts B1 and B2. The conductive area 12 of the base unit includes a plurality of circular electrical contacts 28 disposed in a rectangular array. Of these, electrical contacts 28, contacts marked A1 and A2 are active in a sense that they receive power from the power supply 22. It will be appreciated that the plurality of electrical contacts 28 allow for a wide range of movement in the X and Y directions and a 360° freedom of rotation around the Z axis for which placement of the electrical contacts is still active. The conductive area 12 of the base unit may be defined by a top surface of a desktop, whereas the conductive area 14 of the adaptor unit may be built into a notebook computer with the contacts A1 and A2 mounted on a bottom surface of the notebook computer. In some cases the contacts A1 and A2 may be built into the notebook computer itself. In other cases, the contacts A1 and A2 may be part of an adaptor pad with conductive areas 12. The adaptor pad may be attached to an underside of the notebook computer using an electrical wire lead that can be connected directly to a charging port of the notebook computer.

In the example shown in FIG. 3 of the drawings, the contacts 28 are arranged as an array of circles of radius R with a horizontal and vertical spacing D between adjacent circles. The adaptor contacts A1, A2 in this example, each comprises a circle of radius (R+D/2)*sqrt(2) and with at least a spacing greater than 2R.

In the example of FIG. 3, when the notebook computer is placed on the desktop at any arbitrary position and angle, two base contacts B1 and B2 that satisfy the above three conditions can always be found. These two contacts, B1 and B2 can be used to close a circuit with a notebook computer through two notebook computer contacts A1, A2. It is to be appreciated that other spacing, contact sizes, and placements may be used. For example, rather than just having rows and columns, the base unit may comprise electrical contacts arranged in a honeycomb pattern with interleaving non-conductive areas. Alternatively, instead of having circular base contacts, the base contacts may be linear and be disposed in a linear array.

In FIG. 3, for ease of understanding, load 26 symbolizes the electrical aspects of the notebook computer and, the power source 22 indicates a power supply. It will be appreciated by one skilled in the art that the load 26 and the power source 22 may in reality be quite complex.

Figure 4A:
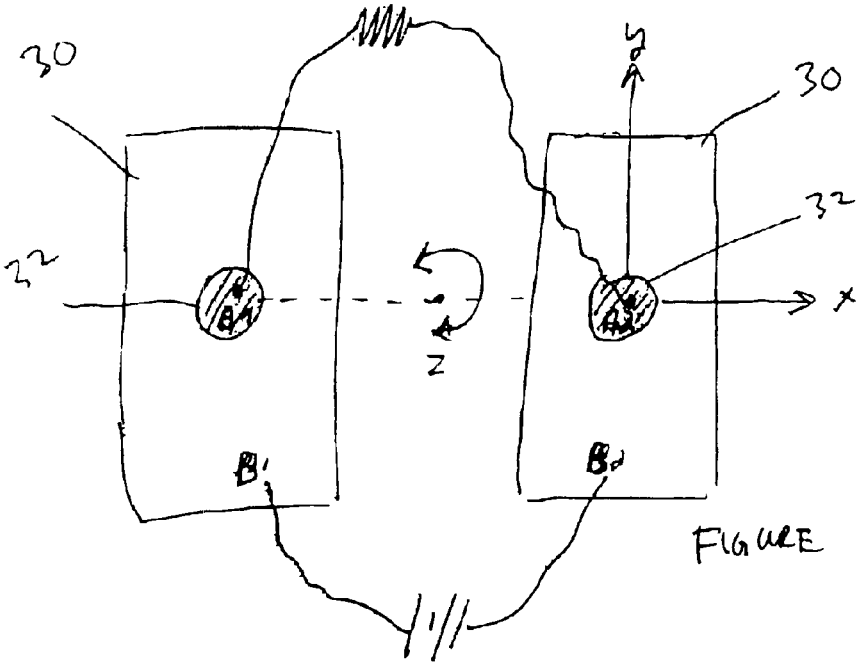
FIG. 4 shows a case of a coupling system which does not require dynamic power switching to contact.
Figure 4B:
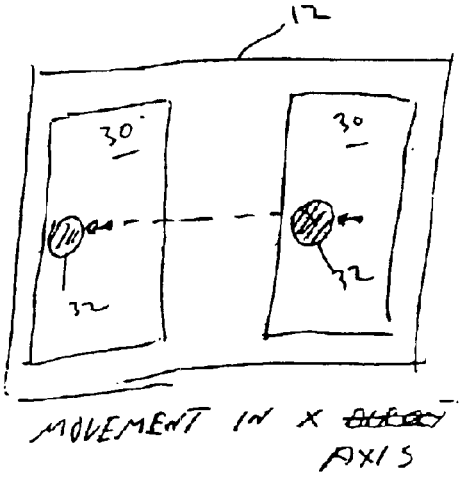
Figure 4C:
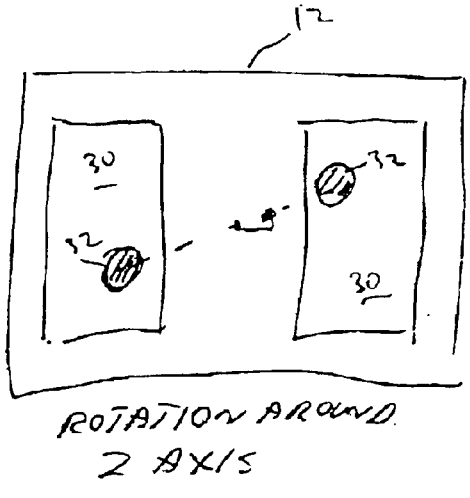

FIG. 4 shows a case of a CS which does not require dynamic power routing or switching to the base contacts. Referring to FIG. 4, it will be seen that the electrical contacts of the base (hereinafter referred to as the "base contacts") B1 and B2 are in the form of the form of two rectangular pads 30. As before, the electrical contacts of the adaptor unit A1 and A2 (hereinafter referred to as "adaptor contacts") are in the form of two circular contact pads 32. The arrangement shown in FIG. 3, allows limited linear movement along the X and Y axes and limited rotational movement about the Z axis. The example of FIG. 4 does not require dynamic power switching to the base contacts. Further, movement along the X and Y axes is limited in the sense that an adaptor contacts 32 must always make contact with a base contact 30. Thus, for example as can be seen in FIG. 4B of the drawings movement along the X axis can occur until the adaptor contacts 32 reach the left edge of the base contacts 30. Similarly, rotation around the Z axis is limited in the sense that the adaptor contacts 32 must always make contact with the base contacts 30. Thus, in example shown in FIG. 4C of the drawings, rotation along the Z axis is permitted as long as adaptor contacts 32 make contact with base contacts 30.

In order to control power application to a multi-contact coupling system, preferably in idle state, base contacts B1 and B2 are not energized. When a load is connected to the base contacts B1 and B2, a sensing unit in the base unit detects the load and switches power to the contacts B1 and B2 based on information and properties of the load. In one case, the power is of a predefined voltage and polarity, or frequency. In some cases, the sensing unit may sense various parameters such as operational status, identification, and power requirements from the load and perform authentication, authorization and compatibility checks before providing power to contacts B1 and B2 using the required voltage and polarity. In yet other cases, the base or charging unit may include a surface with a plurality of exposed contacts and may be configured to supply power to multiple loads, each connected to a further set of contacts and having different voltage characteristics. In some cases, the charging unit will provide protection against short circuits and overloads when contacts of the charging unit are connected, thus providing shock protection when exposed contacts of the charging unit are touched when an electrical load is not present.

Figure 5:
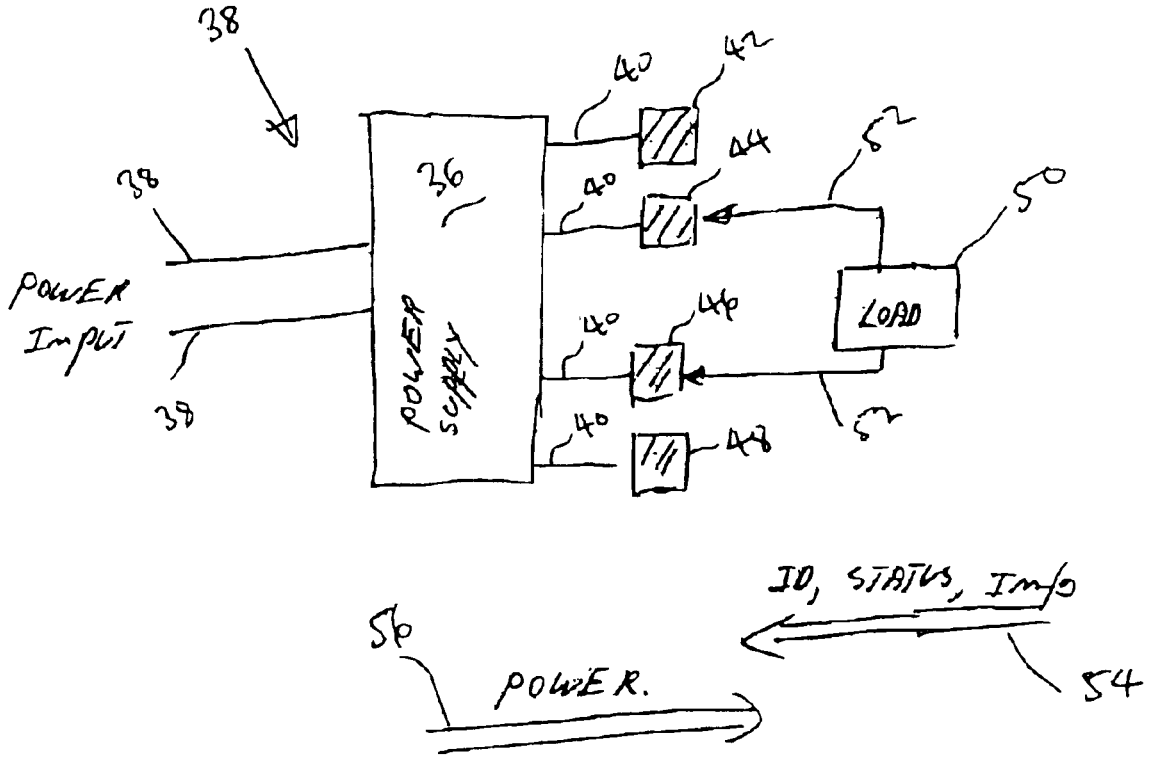
FIG. 5 shows a block diagram of a base or charging unit in accordance with the invention.

FIG. 5 of the drawings shows a block diagram of one case of a base or charging unit of the present invention. The charging unit includes a power supply 36 which is electrically connected via power input lines 38 to a power source and via power output lines 40 to electrical contacts 42 to 48. As can be seen, electrical load 50 which represents, for example electrical circuitry of a notebook computer, is electrically connected via electrical lead lines 52 to contacts 44 and 46.

The power supply 36 receives power from a standard household current supply, but in some cases may also use other sources, such as generators, solar panels, batteries, fuel cells, etc. each separately, or in any combination. In the current art, contacts of a power supply generally provide voltage in a preset voltage, frequency and polarity, independently of an actual load 50 attached to the power supply 36. In the present case, the power supply 36 detects when, where, and how electrical load 50 is connected to the power contacts 42–48 and may sense information such as identification, product type, manufacturer, polarity power requirements, and other parameters and properties of the load and the connection type required. The base unit uses this information to connect the power supply 36 to the electrical load 50. Thus, in accordance with aspects of the present invention, authentication and compatibility checks may be performed before providing power to an electrical load. Further a power supply may be adapted in terms of voltage, polarity and frequency to the needs of a specific electrical load, thus improving safety by avoiding exposed power connectors when no load is attached, and also providing the ability to power a plurality of electrical loads at the same time, each connected to an arbitrary set of contacts and receiving a different voltage. The exchange and negotiation of information between the electrical load 50 and the power supply 36 is symbolized by arrows 54 and 56 in FIG. 5 of the drawings. For example, arrow 54 indicates that identification and status information associated with load 50 is supplied to a sensing circuit (not shown) of power supply 36 which ensures that the correct voltage, polarity and frequency of power is supplied to electrical contacts 44 and 46.

Figure 6:
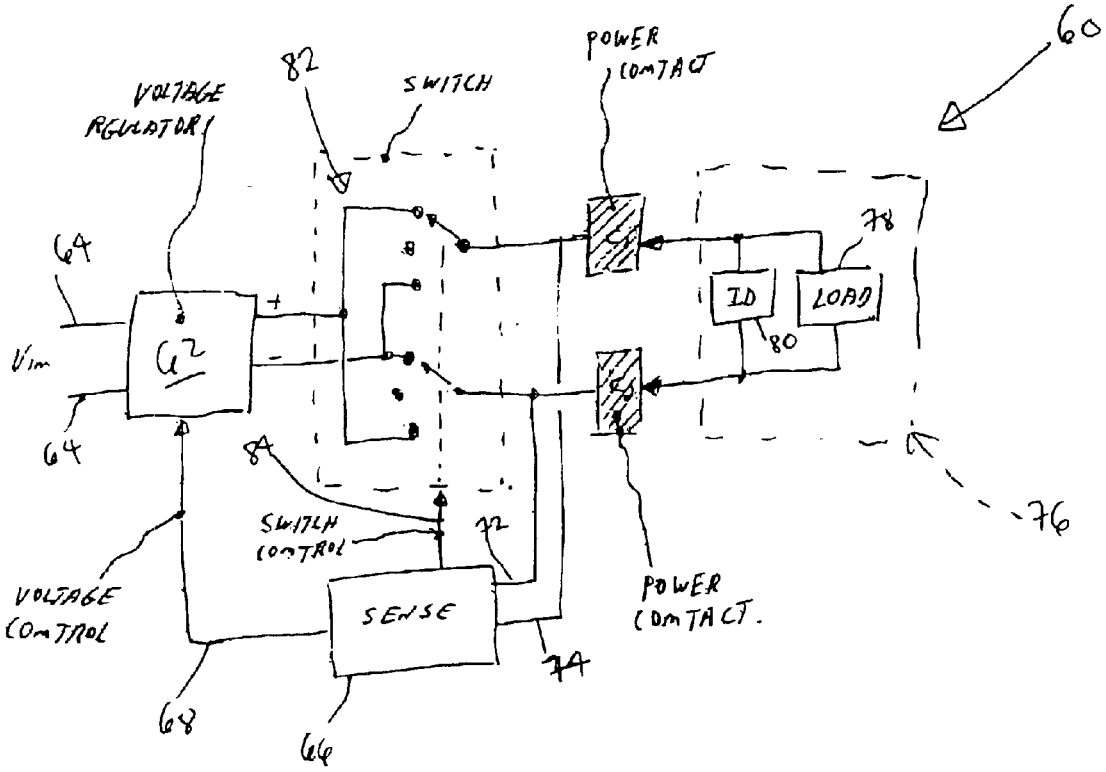
FIG. 6 shows a block diagram of a system for supplying power in accordance with the invention.

Referring now to FIG. 6 of the drawings, a block diagram of a particular instance 60 of a system for supplying power described above is shown. The system 60 may be used to deliver power to a multitude of power contacts, however, for purposes of simplicity, only two power contacts C1 and C2 are shown. Thus, it must be borne in mind that more contacts may be served by the power supply system 60.

The power supply system 60 includes a voltage regulator 62 connected via electrical lines 64 to a current supply which may be a household current supply or any of the other sources mentioned above. A sensing unit 66 is connected via a voltage control line 68 to the voltage regulator 62 and via sensing lines 72 and 74 to power contacts C1 and C2, respectively. The contacts C1 and C2 are electrically connected to a mobile device, for example, a notebook computer 76 which includes an electrical load 78 and an identification load 80. In use, the sensing unit 66 senses the identification load 80 and in particular information such as identification, product type, manufacturer, polarity power requirements and other parameters and properties associated with the electrical load 78. This information is used to control voltage regulator 62 to supply power in the correct voltage, polarity, frequency etc. to electrical load 78 via a switching arrangement 82. As mentioned above, the power supply arrangement 60 generally comprises more than just the power contacts C1 and C2 and thus, during a first stage, the sensing unit 66 scans for the presence of more than one electrical load 78 connected to the power contacts of the power supply 60. After scanning, the sensing unit 66 sends a switch control signal 84 to the switching arrangement 82 to open and close the necessary switches in order to supply power to only those power contacts that have electrical loads connected thereto. The switches used during scanning for the presence of an electrical load may be combined or may be separate from polarity and voltage switches of the switching arrangement 82. Further, advanced semiconductors may be used instead of simple mechanical or relay type switches which are indicated in FIG. 6 for the sake of simplicity.

As noted above, the voltage and polarity of the power that is supplied to contacts C1 and C2 are automatically adjusted by sensing unit 66 to match the requirements of load 78. Thus, when two contacts of the load 78 are connected to contacts of the power supply arrangement 60, the sensing unit 66 detects the unique identifier (ID) (represented as identification load 80) of the load 78 through the sensing lines 72 and 74 and uses this ID to determine the voltage, current and polarity requirements of the load 78. If the voltage and the current requirements are in the range supported by the power supply, the sensing unit 66 sends a signal to the switch arrangement 82 to power a source in the right polarity and also sends a signal to voltage regulator 62 to set the required voltage. The sensing is done by applying a minimal, non-destructive sensing voltage or pattern, and observing responses of the identification load or element 80. The ID element 80 may be a simple resistor, that is read with a very low voltage below the activation of the normally non-linear response of the electrical or device load 78. In some cases, the ID element 80 may be a diode, or a resistor and a diode combination, or any passive or active circuit, including conductors and capacitors etc. that can be used to convey the presence and parameters associated with load 78. In some cases, RFID (radio frequency identity) devices (not shown) may be used for probing without electricity.

In yet other cases, a digital ID may be used, and read, with a voltage that is below the active region of the load, or in some cases the adaptor unit may have intelligence to disconnect the load 78 until it establishes a connection or gets power from the base unit. This may be useful, for example, for resistive loads.

When the load 78 is disconnected from the contacts C1 and C2, the sensing unit 66 detects that the device bearing the ID element 80 is not connected to the power supply and turns off the switching arrangement 82, thereby disconnecting the power from the contact C1 and C2. In some cases, the base unit may disconnect based on a sensing of a mobile device current usage passage.

Figure 7:
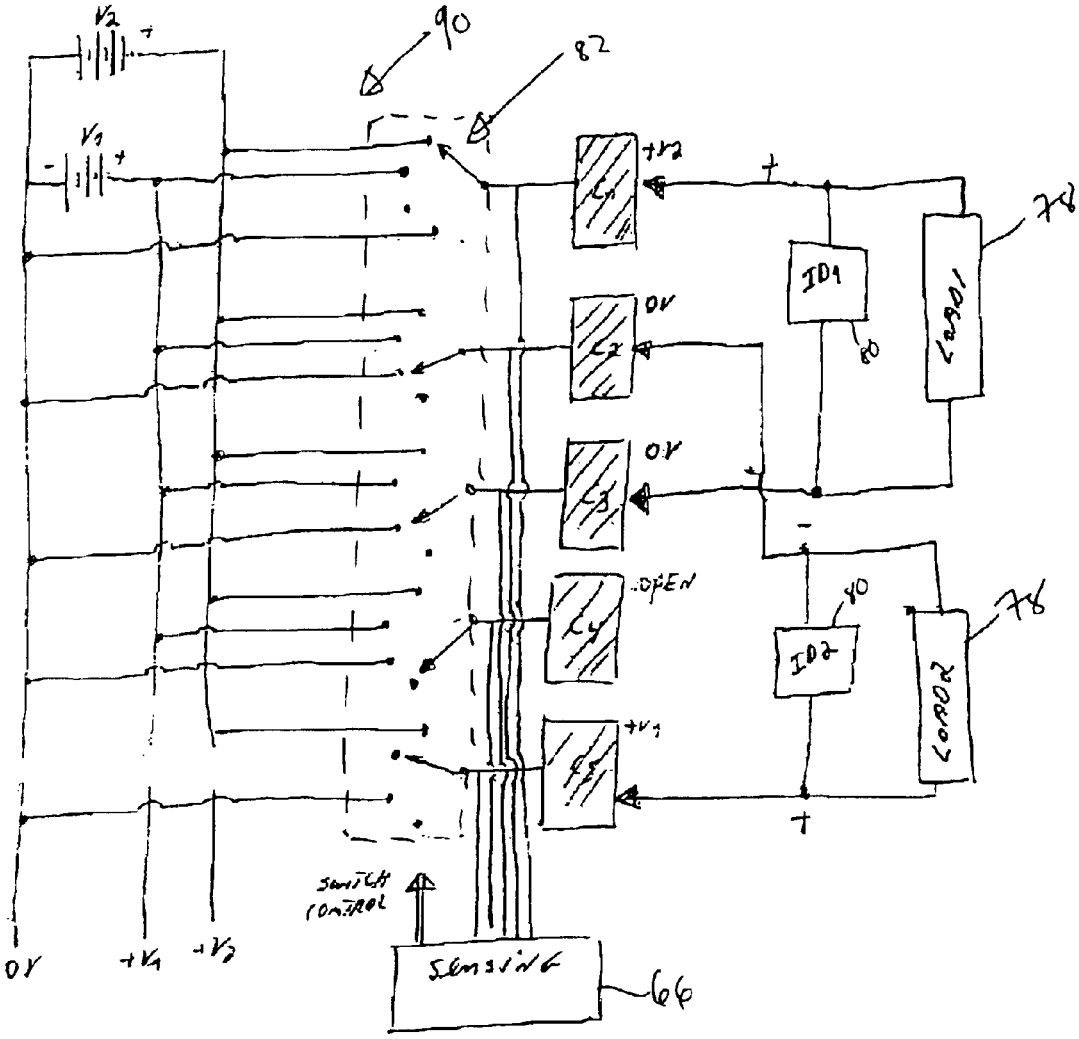
FIG. 7 shows a block diagram of a power provisioning system having multiple contacts in accordance with the invention.

FIG. 7 shows a block diagram of a power provisioning system 90 having multiple contacts C1, C2, C3, C4 and C5. The contacts C1–C5 are used to provide power to electrical loads 78 which are denoted as Load 1 and Load 2 in FIG. 7.

ID elements 80, denoted as ID 1 and ID 2 respectively, provide identification information associated with Load 1, and Load 2 respectively, as described above. Sensing unit 66 controls a switching arrangement 82 to provide power at two predefined voltage levels (V1 and V2) to the loads 78, while automatically adapting the power polarity for each load 78. It will be appreciated by one skilled in the art, that rather than having fixed voltage rails, for example, two programmable rails may be used, and the parameters reported from sensing of the ID elements 80 may be used to select the required voltages. When the sensing unit 66 detects that identification element ID 1 is connected between power contacts C1 (+) and C3 (−), the sensing unit 66 activates the switches of contacts C1 and C2 to connect C1 to the (+) side of power source V1 and connects C2 of the (−) side of the power source V1. In a similar way, the Load 2 is connected to V2 in the correct polarity through C2 and C6. The sensing unit 66 may typically comprise a microcontroller and adaptation circuitry, including resistors, diodes, capacitors and possibly active components as well. Naturally, there will be a power supply to the sensing unit 66 itself, which has not been shown in FIG. 7, so as not to obscure aspects of the present invention.

As mentioned above, control switches may be solid state or relays. In some cases, the ID elements may not only be used to provide identification information but may actually control power flow to a the device (not shown) to which it is connected by means of a switch (not shown), In these cases, the ID elements may include basic control, verification of voltage and current type (AC, DC etc.) and other auxiliary functions. In yet other cases, the adaptor unit may receive commands from the base unit (e.g. turn power on, set ID unique to the pad, etc). Further, the adaptor unit may be integrated with the power management of the device to which it is connected (e.g. for retrieving information about battery state, CPU usage etc.).

The above described power provisioning system may be combined with other elements to form a complete system that allows a user more freedom when using a notebook computer, for example, at a desk or similar environment, such as a home office, a hotel, an office, or even at a kiosk at an airport or other public place.

Figure 8:
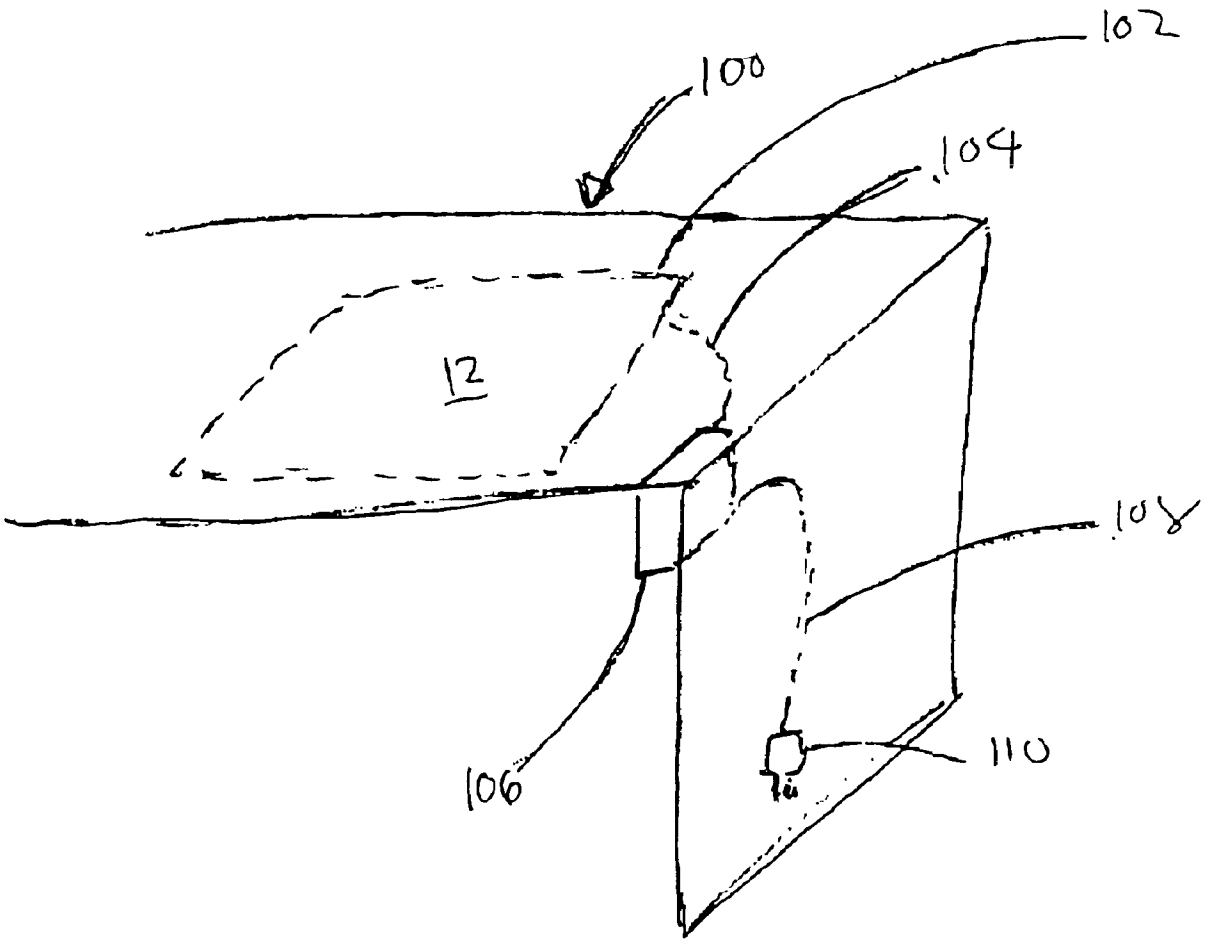
FIG. 8 shows a block diagram of a desk and a mat in accordance with the invention.

FIG. 8 of the drawings shows a desk 100 on which is placed a desk mat 102. The desk mat 102 includes a conductive area 12 with electrical contacts as described above. The desk mat 102 may be integrated into the desk 100.

In one case, the desk mat 102 includes a conductive plastic that may be applied in a thin layer on top of a metallic conductor interleaved with non-conductive material and surrounded by conductive plastic and metal. In other cases, color metallic areas may be silk screened onto mat 102, leaving sufficient openings for contacts. In yet other cases, acidic etchings into a metal substrate may create openings to deposit colored resins, in a process similar to the anodizing of aluminum. In yet other cases, chrome-plated or nickel-finished round metal contacts may be embedded in a rubber mat. All of the above approaches can be used to make a desk mat product that is visually appealing to consumers, and functions as a base for a charging or power unit as described above.

As can be seen in FIG. 8, a cabling system 104 which is hidden within the desk 100 connects to a power supply 106 that contains both the power source itself and the sensing and switching arrangement described above. A power cord 108 ending in a power connector 110 plugs into a regular household AC outlet, of the type available in homes and offices.

Figure 9:
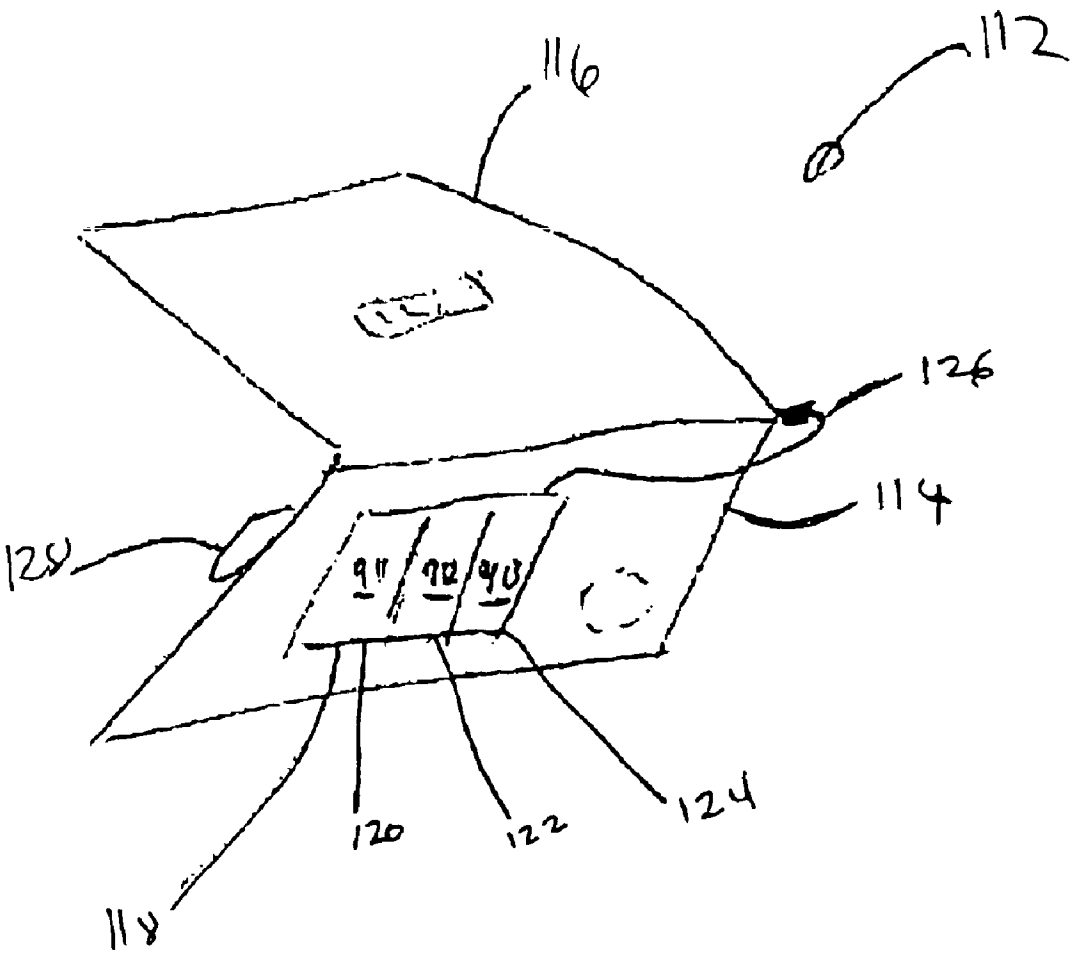
FIG. 9 shows a schematic drawing of an adaptor unit releasably secured to a notebook computer.

FIG. 9 shows one case in which an adaptor unit or piece 118 is releasably secured to a notebook computer 112. The notebook computer 112 is shown from a lower rear-end and includes a base section 114 and a lid section 116. As can be seen in FIG. 9 of the drawings, the notebook computer 112 is slightly opened with the lid section 116 spaced from and hingedly connected to the base section 114. The adaptor piece 118 is attached to an underside of the base section 114 using, for example, hook-and-pile fasteners, mounting tape, or any other suitable fastening arrangement including but not limited to screws, bolts, glue, cement, snaps etc. The adaptor unit 118 has, in this example, three separate areas 120, 122 and 124 as can be seen. The areas 120 and 124 may be conductive surfaces and the area 122 may be an insulator. A cable 126 is used to connect the adaptor unit 118 to the notebook computer 112 via a regular power supply port of the notebook computer 112.

Also shown in FIG. 9, a wireless network card 128 protrudes from a port of the notebook computer 112.

In some cases, the adaptor unit 118 may be integrally formed with the notebook computer, or in other cases, it may more specifically integrated with a battery unit or an enclosure for a battery unit, hence requiring a special cable or attachment.

Also, in a case in which the cable 126 is included, a convenient recepticle may be offered, so that the user does not have to unplug the adaptor unit in case of using a regular charger with a base. In other cases, the adaptor unit may be electrically disconnected, so as to avoid hazards by exposing live contacts.

Figure 10:
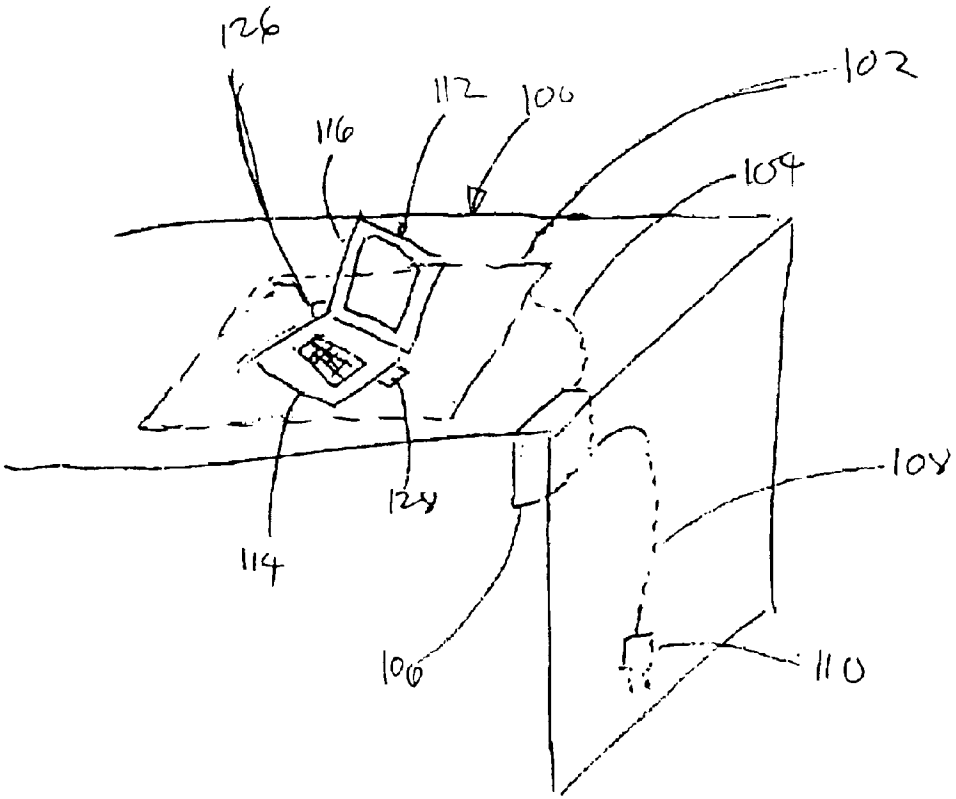
FIG. 10 shows a schematic drawing of a notebook computer placed on a mat in accordance with the invention.

FIG. 10 shows a schematic drawing in which the notebook computer 112 is placed on a conductive mat 102 of a desk 100. Each of the components 100, 102 and 112 have been described with reference to FIGS. 8 and 9 respectively.

As can be seen in FIG. 10, notebook computer 112 is placed at an odd angle, to exemplify that such a device may, according to the novel art of this disclosure, be placed in any position on conductive mat 102, thus allowing for notebook computer 112 to be charged or powered while the notebook is in use, without having to plug in any cable or carry any power supplies.

It is to be appreciated that many variations are possible without departing from the spirit of the novel art of this disclosure. For example, contacts 120, 122 and 124 of the adaptor unit 118 may be round as opposed to being square and may have dimensions that match those of the notebook base section 114, rather than being scaled to a functional minimal size. In other cases, adaptor unit 118 may connect to a docking connector for notebook computer 112, as opposed to using a power cord arrangement. In one case, adaptor unit 118 may be integrated into the standard enclosure of a notebook, thus eliminating a need for a separate, add on device.

Desk mat 102 may also have many variations. In one case desk mat 102 may be used in conjunction with a standard power supply provided by a notebook manufacturer and may contain by itself only the sensing and switching functionality, rather than the full power supply.

Figure 11:
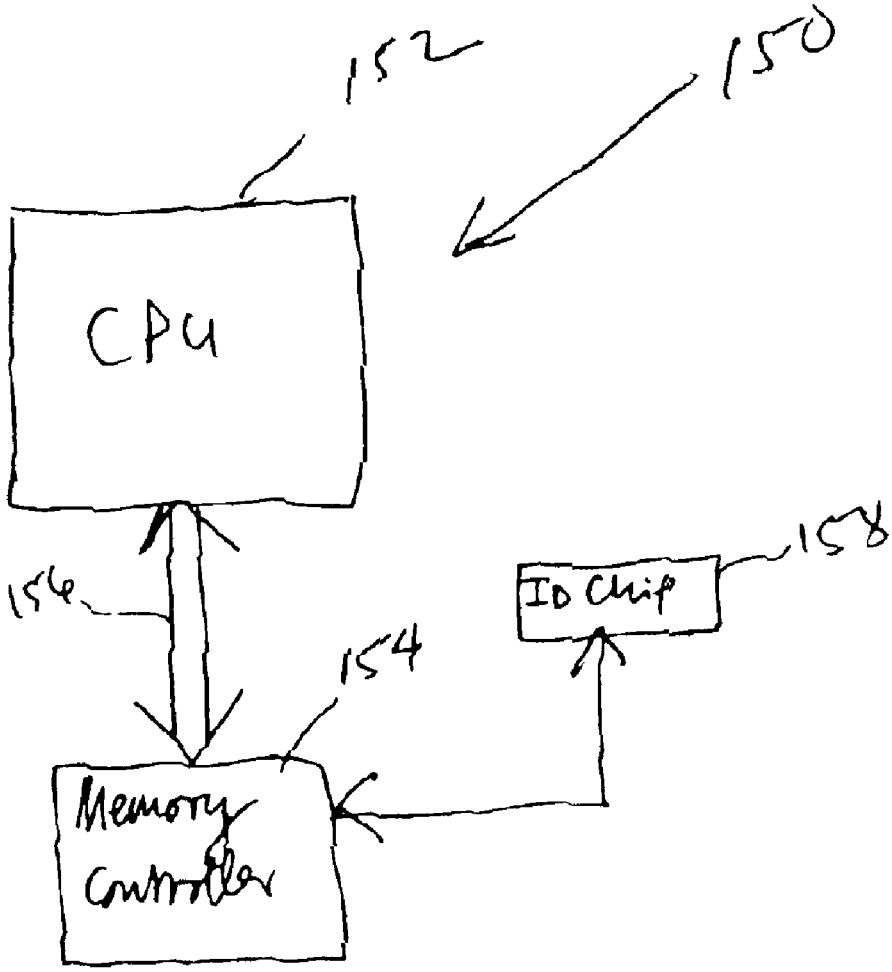
FIG. 11 shows a block diagram of a chipset in accordance with the invention.

In yet other cases, the system may be used to transmit data over the established electrical connections, as opposed to just power. This may be achieved either by using additional contacts, or by modulating signals onto the existing power leads and adding a filter (i.e. inductor/capacitor) to separate DC supply from high speed data signals such as Ethernet signals etc. In such cases, an Ethernet port may be offered in both a desk mat 102 and a cable on adaptor unit 118. Thus, in some cases, the system includes a modulation circuit to modulate a data signal onto the contact. When the contacts are used to obtain connectivity to a network, there is a need to authenticate the mobile device and its user before allowing connectivity to the network. Thus, before a mobile device is allowed to connect to a network, a hand shaking operation is performed wherein information is exchanged between the mobile and the contactor device. The hand shaking information may include information such as a model, make and manufacturer of the mobile device, and authentication information to connect to the network. The hand shaking information may also include the power settings for the mobile device. The hand shaking information may be programmed into an ID chip of the mobile device using microcode or it may be hard-coded in a storage area within the ID chip. In one case, see FIG. 11 of the drawings, a chipset 150 is provided which includes a central processing unit (CPU) 152 which is connected to a memory controller 154 by a data bus 156. Coupled to the memory controller is an ID chip 158 which includes the hand shaking information described above. In use, the chipset 150 may be electrically connected to an adaptor device which, preferably is integrated with a mobile device and when the mobile device is placed on a contactor in accordance with the invention, the ID chip 158 sends the hand shaking information including the authentication information to the contactor which then verifies the information and enables network connections.

Other network standards besides Ethernet may also be supported, as desired or required. In some cases, wireless methods may be used for the data transmissions. These methods include but are not limited to optical methods including infrared (IR), inductive coupling, capacitive coupling, or radio frequency with our without modulation. Some cases may include virtual docking connections or regular local area network connections, or both.

Many variations may be realized by shifting the partitioning or integration of features among various elements of the system described herein. In some cases, for example, a mat 102, may be integrated into the desk 100. In other cases, the mat may be a foldable or rollable mat reduced in size for easy portability, for the convenience of travelers. In some cases, input devices may be integrated into the base charging unit, for example a tablet or a large touch pad, the pad surface may be mouse friendly (both to mechanical and optical mice) or it may be used to power semi-mobile devices such as desk lamps, electrical staplers, etc. Additionally, the desk mat 102 may be of an anti-static material (thus making it safer than using no mat at all). In some cases, extensions may be offered as modules, including making the mat area of the charging power device modular (cutting to order, tiles etc.). In some cases, the base unit provides a standard power and each device/adaptor converts it to the level needed by its respective device. Also, in some cases some information and sensing is done in the reverse direction (i.e. base to device) and the device also makes some decisions on power switching (for example is this space safe to use). In some cases, the contact surface may be made like a fabric (printed or woven), and applied to walls in offices, schools, homes, stores etc. In yet other cases, the sensing or interrogation before releasing power may be used in existing building wiring, controlling outlets. Thus, only an authorized device can draw power. This may have important benefits such as improving safety (e.g. for children), or for security against power theft in public or semipublic places, or avoiding overload to a back-up network. In a hospital, for instance, non-essential units accidentally plugged in to an emergency power system would not work without an override.

In some cases, the base unit may do power allocation and management, e.g. between multiple devices being powered at the same time. The functionality of the system can be divided in many ways between the pad surface and the device. The system can also provide for an adapter/device to have more than two contacts and it can do smart power routing/conversion as well. In some implementations, the surface contacts or some of them can be energized or grounded all the time (e.g. the interleaving geometry). In yet other cases, the surface may have only one pair of contacts. In some cases 'handshaking', does not require bi-directional communication or communication at all. Some implementation can use for example simple analog sensing of resistance or diode.

Also, in some cases, sensing may entail multiple steps, such as 1. check for diode 2. check resistor and 3. check ID digitally. Each of the steps may use different voltages, and in some cases only one, or two or three may be done. Further, tests may also include DC, AC and modulated probing signals.

Although the present invention has been described with reference to specific exemplary embodiments, it will be evident that various modifications and changes can be made to these embodiments without departing from the broader spirit of the invention as set forth in the claims. Accordingly, the specification and the drawings are to be regarded in an illustrative sense rather than in a restrictive sense.

What is claimed is:

1. An electrical coupling device comprising:

a contactor device including a contactor body defining a generally flat contactor surface shaped and dimensioned to make physical contact with an adaptor surface of an adaptor device;

a plurality of electrical contacts on the contactor body at or adjacent the contactor surface, a number, shape, dimension, and spatial configuration of the electrical contacts permitting at least two of the electrical contacts to be electrically connected to corresponding electrical contacts of the adaptor device to close an electrical circuit between the contactor device and the adaptor device when the adaptor surface of the adaptor device is brought into physical contact with the contactor surface of the contactor body, there being no need for aligning the electrical contacts of the adaptor device and the contactor device;

a control mechanism comprising a sensing circuit to select a pair of the electrical contacts of the contactor body to energize in order to complete the circuit; and a controller to energize the selected pair based on input from the sensing circuit, wherein the sensing circuit selects multiple pairs of electrical contacts to energize; and the controller energizes each selected pair.

2. The electrical coupling device of claim 1, wherein the electrical contacts with the contactor body are normally de-energized.

3. The electrical coupling device of claim 1, wherein the contactor body defines a flat mat.

4. The electrical coupling device of claim 3, wherein the contactor body is integrated into an article of furniture.

5. The electrical coupling device of claim 1, further comprising a modulation circuit to modulate a data signal which is transmitted by the electrical contacts to the adaptor device.

* * * * *